US006338228B1

(12) United States Patent
Chevalier

(10) Patent No.: US 6,338,228 B1
(45) Date of Patent: Jan. 15, 2002

(54) MODULAR ELEMENT FOR MAKING UP A CEILING, AND A CEILING MADE UP OF AN ASSEMBLY OF SUCH MODULAR ELEMENTS

(75) Inventor: Jean-Claude Chevalier, St Anne sur Brivet (FR)

(73) Assignee: Chantiers de l'Atlantique, Paris (FR)

( * ) Notice: Subject to any disclaimer, the term of this patent is extended or adjusted under 35 U.S.C. 154(b) by 0 days.

(21) Appl. No.: 09/309,876

(22) Filed: May 11, 1999

(51) Int. Cl.[7] ..... E04C 2/52

(52) U.S. Cl. ..... 52/220.6; 52/484; 52/578; 52/22; 52/588.1; 52/506.01

(58) Field of Search ..... 52/484, 578, 220.6, 52/22, 588.1, 506.01

(56) References Cited

U.S. PATENT DOCUMENTS 4,991,370 A 2/1991 Gailey et al.

FOREIGN PATENT DOCUMENTS

| | | | |
|---|---|---|---|
| BE | 902.547 A | | 9/1985 |
| DE | 87 03 146.9 U | | 7/1987 |
| DE | 44 03 403 A1 | | 8/1995 |
| FR | 2 343 914 A | | 10/1977 |
| GB | 2 153 874 A | | 8/1985 |
| GB | 2153874 A | * | 8/1985 |
| GB | 2 174 433 A | | 11/1986 |

* cited by examiner

*Primary Examiner*—Beth A. Stephan
(74) *Attorney, Agent, or Firm*—Sughrue, Mion, Zinn, Macpeak & Seas, PLLC

(57) ABSTRACT

A modular element for making up a ceiling, said element being a metal section member whose section on a plane perpendicular to the length of the element has a flat bottom web with two vertical flanges: a front flange and a first rear flange, the front flange being extended by an outwardly-extending front horizontal limb parallel to the web, and the first rear flange being extended by a first frontwardly-extending horizontal rear limb, wherein, beyond a certain margin x from each end of said element, said first rear limb is provided with an extension including at least one second rear vertical flange.

6 Claims, 5 Drawing Sheets

MODULAR ELEMENT FOR MAKING UP A CEILING, AND A CEILING MADE UP OF AN ASSEMBLY OF SUCH MODULAR ELEMENTS

The present invention relates to a modular element for making up a ceiling, and to a ceiling made up of an assembly of such elements.

The invention is particularly applicable to making a ceiling for living quarters on ships.

BACKGROUND OF THE INVENTION

FIGS. 1 and 1A shows a known system for making a ceiling for living quarters on a ship. The ceiling is made up of a plurality of assembled-together modular elements such as metal sheets 1 that are slightly interfitting with open joints 12 being provided between them to enable any of the sheets to be removed individually by moving it transversely in the direction indicated by arrow F.

The sheets 1 are section members whose cross-section (perpendicular to their length) has a bottom web 2 with two vertical side flanges 3 and 4, one of the flanges being extended by an outwardly-extending horizontal top limb 5, and the other flange being extended by an inwardly-extending horizontal top limb 6.

At each of its ends, the sheet is also provided with a vertical flange but each end vertical flange is not provided with a top limb. The sheets have a length (perpendicular to the plane of the figure) of about three meters, and they are supported firstly at their ends by bordering section members to the undersides of which they are fixed by means of screws at 7 in the open joints 12, and secondly by joists 8 distributed over the length of the sheets 1, by means of hooks 9 which are obtained by punching out the bottom of the joist section member, and on which the rear limbs 6 of the sheets 1 hook.

The joists 8 (shown in section in FIG. 1A) are themselves supported by suspension rods 10 fixed to the upper deck 11. That suspension system using joists and suspension rods is necessary because supporting the sheets 1 at their ends only, by means of the bordering section members, is insufficient in view of the flexibility of the sheets, in particular since some of them also support certain accessories such as smoke detectors, light fittings, etc.

OBJECTS AND SUMMARY OF THE INVENTION

An object of the present invention is to simplify assembly, and to reduce the number of parts involved.

To this end, the invention provides a modular element for making up a ceiling, said element being a metal section member whose section on a plane perpendicular to the length of the element has a flat bottom web with two vertical flanges: a front flange and a first rear flange, the front flange being extended by an outwardly-extending front horizontal limb parallel to the web, and the first rear flange being extended by a first frontwardly-extending horizontal rear limb, wherein, beyond a certain margin x from each end of said element, said first rear limb is provided with an extension including at least one second rear vertical flange.

Advantageously, in front of said second rear vertical flange, and extending directly from said first rear limb, said extension includes a hairpin return face, said return face being directly extended by said second rear flange.

In a particular embodiment, said second rear vertical flange is extended by a second rear horizontal limb extending frontwards.

The invention also provides a ceiling made up of modular elements as defined above, assembled together one behind the other, wherein the front limb of each modular element, except for the front limb of the first element, is engaged in part over the first rear limb of the preceding element, so as to leave an empty space between the first rear flange of the preceding element and the front flange of the following element, said first element having its front limb fixed under and against an edge section member associated with a first vertical bulkhead, wherein the last element is a special element whose section has a flat bottom web, a front flange, and a first rear flange, the front flange being extended by a frontwardly-extending front limb, and the first rear flange being extended by a rearwardly-extending rear limb, said rear limb of said last element being fixed under and against an edge section member associated with a second vertical bulkhead parallel to said first bulkhead, and wherein each of the two longitudinal ends of each element is fixed at the front limb under and against a bordering section member associated with a vertical bulkhead disposed perpendicularly to the first bulkhead and to the second bulkhead.

BRIEF DESCRIPTION OF THE DRAWINGS

An embodiment of the invention is described below with reference to the accompanying drawings, in which.

DETAILED DESCRIPTION

Firstly, the modular elements of the invention that are used to make up a ceiling are described with reference to FIGS. 3 and 4.

Figure 3:
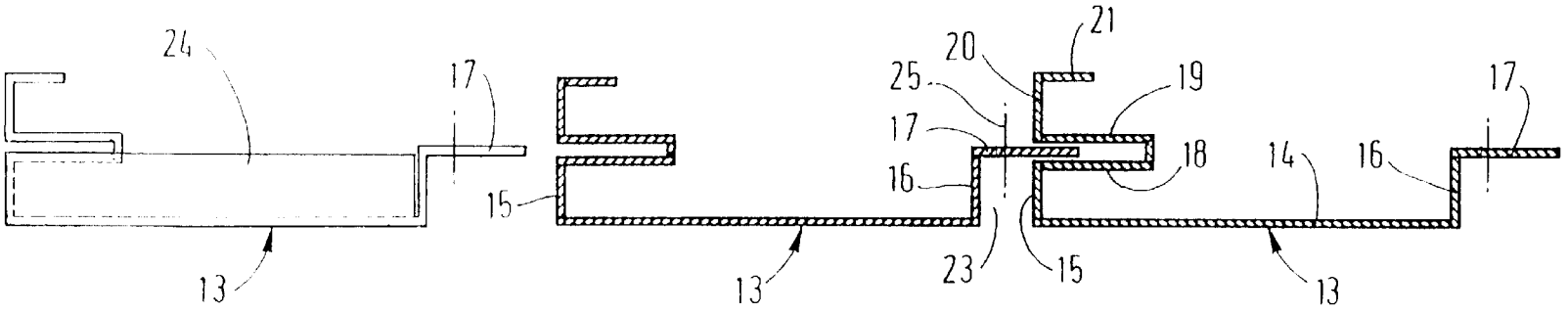
FIG. 3 shows three modular elements, two of them being shown in cross-section in their respective positions, when they are installed, and one of them being seen end-on and not in section and shown in isolation and not interfitted with the preceding element.
Figure 4:
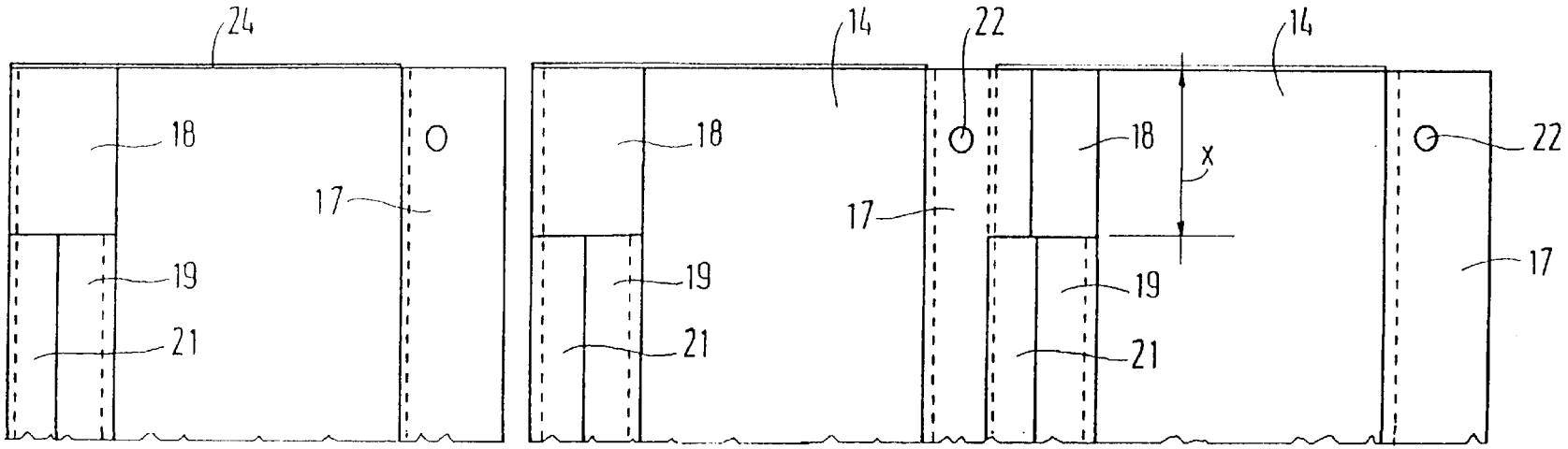
FIG. 4 is a fragmentary plan view of FIG. 3, showing only one end of each of the modular elements.

FIG. 3 is a section view and FIG. 4 is a fragmentary plan view showing three modular elements 13 of the invention.

Each modular element 13 is a metal section member that is, for example, about 3 meters long, and whose cross-section is as shown in FIG. 3, i.e. it comprises a flat bottom web 14, a first rear vertical flange 15, and a front vertical flange 16. The front flange 16 is extended by a front horizontal limb 17 extending parallel to the web 2 and outwards, i.e. frontwards using the convention adopted herein. The first rear flange 15 is also extended by a first rear limb 18 that is also horizontal and that also extends frontwards, and therefore inwards. In the invention, beyond a certain margin x from each end of the modular element (see FIG. 4), the first rear limb 18 is extended by a hairpin return face 19 back to a position vertically above the first rear flange 15, then by a second rear flange 20 that is also vertical, and finally by a second rear limb 21 that is horizontal and that extends frontwards.

Figure 6:
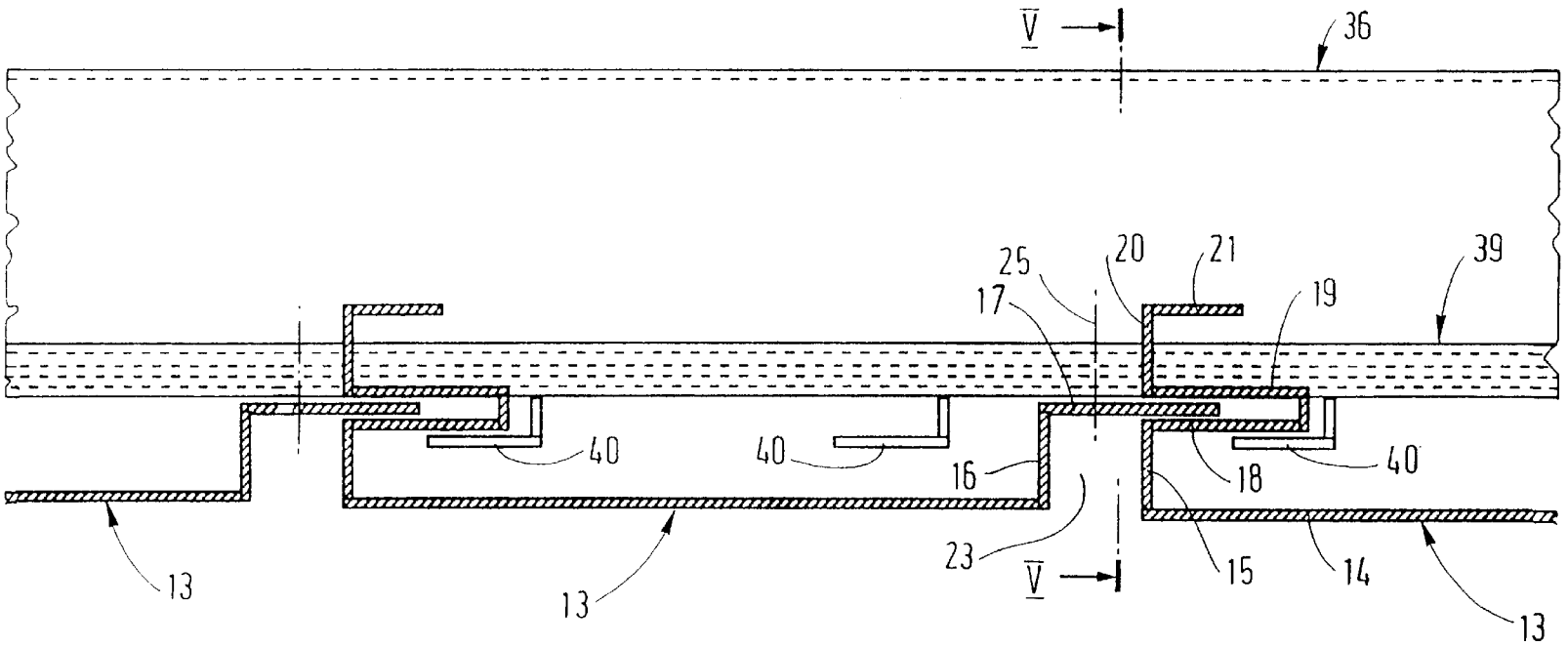
FIG. 6 is a view in section on VI—VI of FIG. 5.

At each end of the modular element, the front limb 17 is provided with a hole 22 for fixing the elements against a bordering section member as explained below. The margin, of length x, over which there is no return face 19, no second rear flange 20, and no second rear limb 21, serves to enable the modular element 13 to abut via the first rear limb 18 against said bordering section member so that the web 14 remains in a horizontal position as shown in FIG. 6 and described below.

Figure 2:
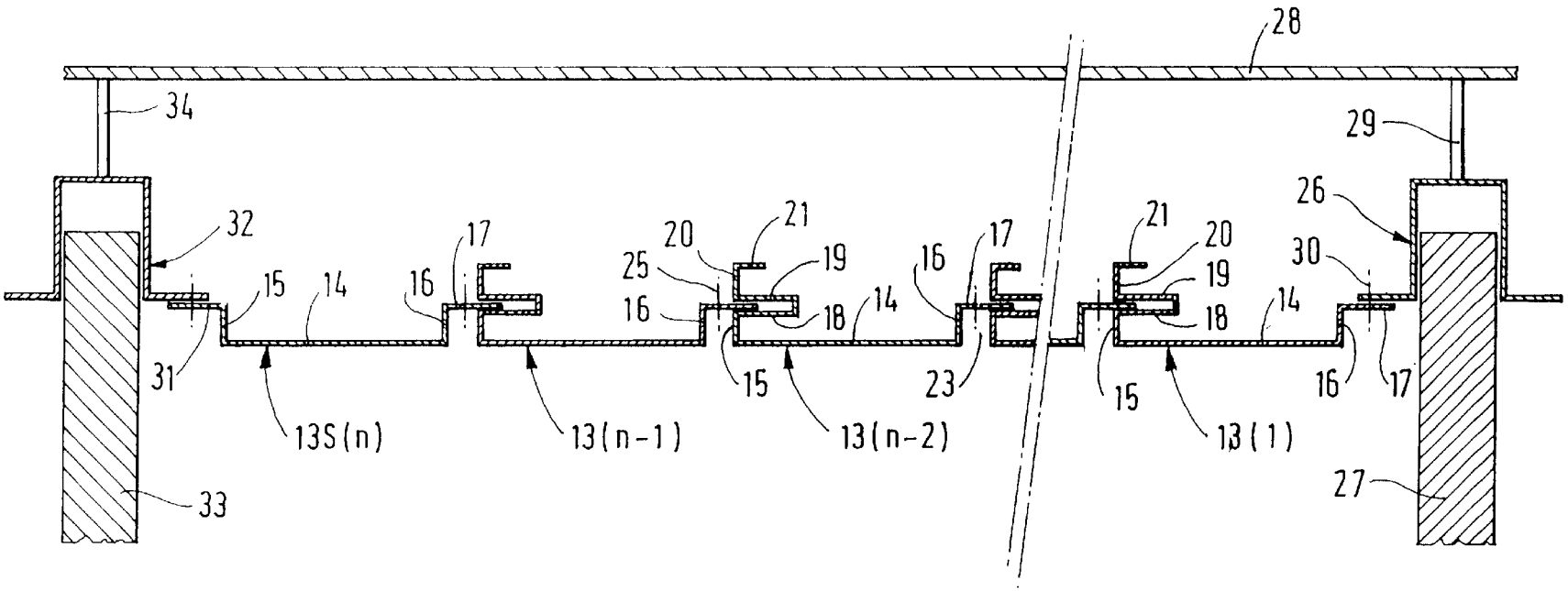
FIG. 2 is a section view of a ceiling of the invention on a plane perpendicular to the length of the modular elements.

In FIGS. 3 and 4, the two elements 13 situated on the right of the figure are positioned relative to each other as they are in practice when they are assembled together to make up a ceiling, as shown in FIG. 2. Thus, the front limb 17 of each element engages in part only in the sleeve formed by the first rear limb 18 and the return face 19 of the preceding element, so that an empty space 23 referred to as an "open joint" is left between the front flange 16 of an element and the first rear flange 15 of the preceding element.

In FIG. 3, the modular element 13 situated on the left of the figure and shown in isolation, is seen end-on. This view shows that the longitudinal end of the element is closed by a vertical flange 24, and this applies to both ends of the element. The vertical end flange is constituted by an extension to the web 14 which is folded over vertically at each end of the element to form said end flange.

The open joint 23 makes it possible for any element 1 of the ceiling to be removed individually merely by sliding it rearwards or frontwards to release its front limb from the sleeve 18–19 of the preceding element, or to release the sleeve 18–19 of the element from the front limb 17 of the following element, after having removed the fixing screw that screws into the bordering section member at each end of the element, as mentioned above and as shown in FIGS. 5 and 6 (described below), the screw passing through the hole 22 in the front limb 17 and being situated in the open joint 23 at 25.

FIG. 2 shows how a ceiling is made up of such elements 1.

The first element 13, referenced 13(1), has its front limb 17 fixed against and under an edge section member 26 that may be referred to as the "head" section member, that caps an end bulkhead 27, and that is connected to the upper deck 28 by rods 29. The limb 17 is fixed to the edge section member 26, e.g. every 400 mm, by screws at 30. Then come the other elements 13. FIG. 2 shows only the first element, referenced 13(1) and the last three elements, referenced **13(*n*-2), 13(*n*-1), and 13S(*n*)**.

The last element **13S(*n*) is a special element comprising, like all the other elements, a bottom web 14, a front flange 16, a first rear flange 15, and a front limb 17. Unlike the other elements, it has its first rear flange 15 extended by a rear limb 31 extending rearwards. The special last element 13S(*n*) has its rear limb 31 fixed under and against an edge section member 32 (head section member) that caps, like the member on the other side, an end bulkhead 33. Like the edge section member 26, the edge section member 32 is connected to the upper deck 28 by rods 34**.

Figure 5:
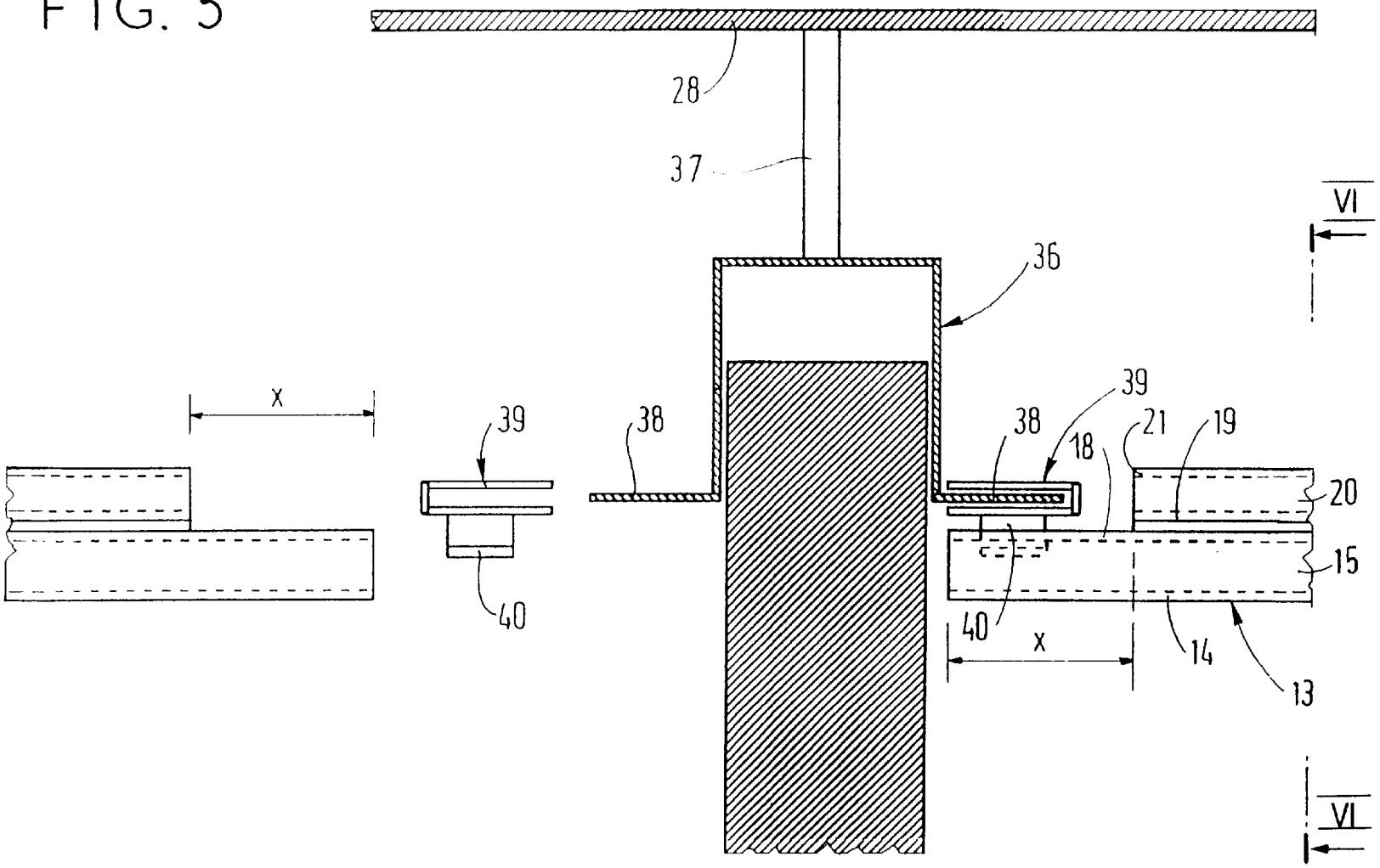
FIG. 5 is a view in section on V—V of FIG. 6 showing how the modular elements are fixed in the plane perpendicular to the plane of FIG. 2.

FIG. 5 is a fragmentary view showing a bulkhead 35 which is a bulkhead perpendicular to the bulkheads 27 and 33 shown in FIG. 2. This figure shows one end of an element 13. FIG. 6 is a view in section on VI—VI of FIG. 5, and FIG. 5 is a view in section on V—V of FIG. 6. Like the bulkheads 27 and 33, the bulkhead 35 is "capped" with a head section member 36 connected to the upper deck 28 by rods 37. A bordering section member 39 provided with a series of hooks 40 is mounted on a horizontal limb 38 of the head section member 36. In the portion of length x having no return face 19, no second rear flange 20, and no second rear limb 21, the first rear limb 18 of each element 13 engages in such a hook 40 while the end of the front limb (see FIG. 6) that engages in the sleeve 18–19 is fixed against the bordering section member 39 by means of a screw (not shown) whose location is referenced 25 in the open joint 23. This screw screws both into the bordering section member 39 and also into the limb 38 of the head section member 36. The screw passes through the hole 22 (FIG. 4) provided at each end of the front limb 17 of each modular element 13.

As shown in FIG. 5, a bordering section member 39 that is not mounted on the limb 38 of the head section member 36 is shown on the left of the bulkhead 35 where an adjacent cabin is situated.

In FIGS. 2, 3, and 6, the two faces 18 and 19 are shown separated from each other by a certain distance. In practice, the interconnecting portion between the two faces is not, as shown, a vertical face, but rather it is merely a fold. In contrast, the second rear flange 20 is genuinely a vertical face whose height is similar to the height of the first rear flange 15, and, in any event, is sufficient to ensure that the longitudinal rigidity of the element is sufficient, in view of the length of the element.

Figure 1:
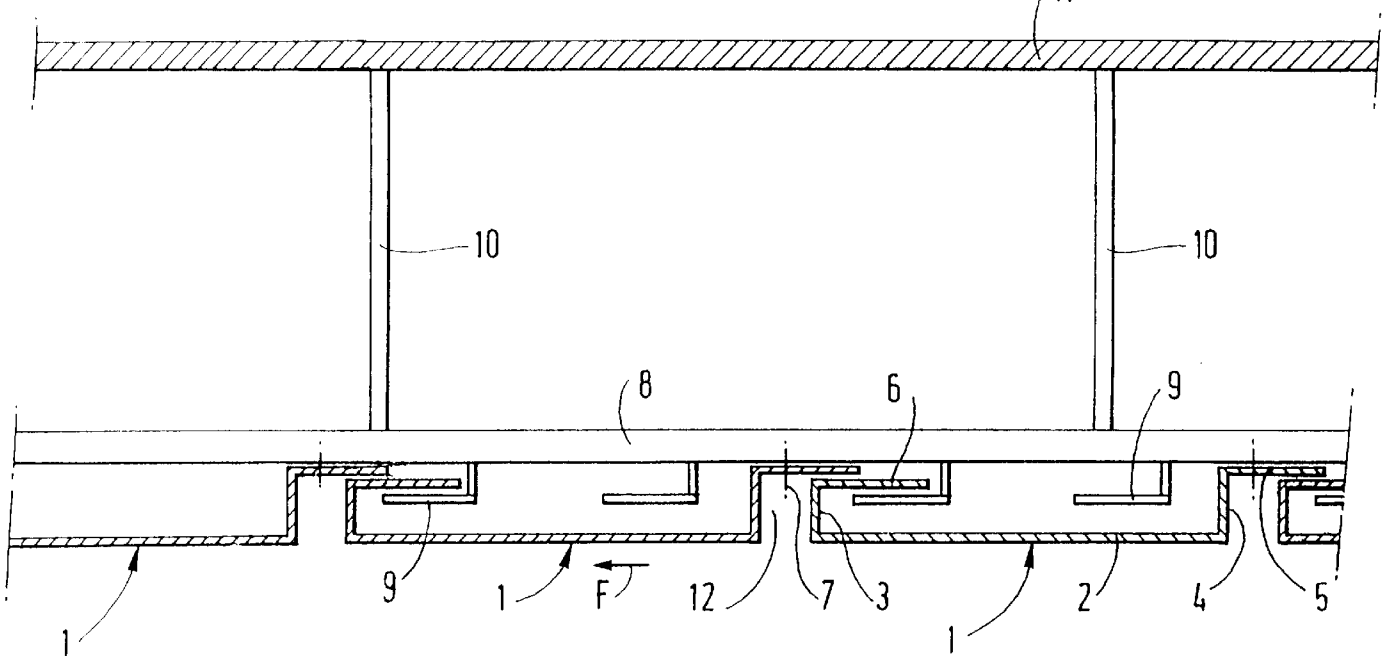
FIG. 1 (described above) shows a known system for making a ceiling for a ship.
Figure 1A:
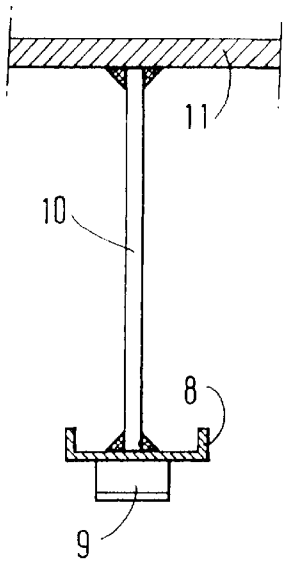

Thus, by means of the elements 13 of the invention which offer sufficient rigidity by means of the additional faces 19, 20, and 21, it is possible to make a ceiling without any joists or joist supports, unlike the prior art shown in FIG. 1, while giving the ceiling an absolutely identical appearance, as seen from underneath.

It is also equally as easy to remove the elements, and the elements can be assembled together much faster. Such a ceiling offers better sound insulation, because there are no longer any obstacles to laying insulation between the ceiling and the upper deck, and there is no longer any sound "short-circuit" via the supporting rods 10 for supporting the joists 8 as shown in FIG. 1. To increase the longitudinal rigidity of the modular elements 13, it is optionally possible to omit the return face 19, and rather to provide a second rear flange 20 directly. Similarly, the second rear flange 20 may optionally not be followed by a second rear limb 21.

What is claimed is:

1. A modular element for making up a ceiling, said element being a metal section member whose section on a plane perpendicular to the length of the element has a flat bottom web with two vertical flanges: a front flange at one end of the length of the element defined as a front end and a first rear flange at an end of the length of the element opposite to the front end defined as a rear end, the front flange being extended by an outwardly-extending front horizontal limb parallel to the web in a direction opposite to an interior of the web, and the first rear flange being extended by a first frontwardly-extending horizontal rear limb in a direction towards the interior of the web, wherein, beginning at a certain margin x taken from a side end of the element in a direction parallel to said rear flange along a surface of the web, said first rear limb is provided with an extension including at least one second rear vertical flange.

2. A modular element according to claim 1, wherein, in front of said second rear vertical flange towards the interior of the web, and extending directly from said first rear limb, said extension includes a hairpin return face extending towards an exterior of the web so as to form with said first rear limb a sleeve opening towards the exterior of the web, said return face being directly extended by said second rear flange.

3. A modular element according to claim 2, wherein said hairpin return face is extended to a position vertically above said first rear flange.

4. A modular element according to claim 1, wherein said second rear vertical flange is extended by a second rear horizontal limb extending frontwards towards the interior of the web.

5. A ceiling made up of modular elements, wherein each of said modular elements comprises a metal section member whose section on a plane perpendicular to the length of the element has a flat bottom web with two vertical flanges: a front flange at one end of the length of the element defined as a front end and a first rear flange at an end of the length of the element opposite to the front end defined as a rear end, the front flange being extended by an outwardly-extending front horizontal limb parallel to the web in a direction opposite to an interior of the web, and the first rear flange being extended by a first frontwardly-extending horizontal rear limb in a direction towards the interior of the web, wherein, beginning at a certain margin x taken from a side end of the element in a direction parallel to said rear flange along a surface of the web, said first rear limb is provided with an extension including at least one second rear vertical flange; and wherein said modular elements are assembled together one behind the other, wherein the front limb of each modular element, except for the front limb of a first one of said modular elements defined as a first element, is engaged in part over the first rear limb of the preceding element, so as to leave an empty space between the first rear flange of the preceding element and the front flange of the following element, said first element having its front limb fixed under and against an edge section member associated with a first vertical bulkhead, wherein said ceiling further comprises a last element whose section has a flat bottom web, a front flange, and a first rear flange, the front flange being extended by a frontwardly-extending front limb that extends in a direction opposite to an interior of the web of the last element, and the first rear flange being extended by a rearwardly-extending rear limb that extends in a direction opposite to an interior of the web of the last element and opposite said frontwardly-extending front limb, said rear limb of said last element being fixed to an edge section member associated with a second vertical bulkhead parallel to said first bulkhead, and wherein each of the first through last elements is fixed at the front limb to a bordering section member associated with a vertical bulkhead disposed perpendicularly to the first bulkhead and to the second bulkhead.

6. The ceiling made up of modular elements according to claim 5, wherein said rear limb of said last element being fixed under and against the edge section member associated with the second vertical bulkhead, and wherein each of the first through last elements is fixed at the front limb under and against the bordering section member associated with the vertical bulkhead disposed perpendicularly to the first bulkhead and to the second bulkhead.

* * * * *